United States Patent [19]

Rajan

[11] Patent Number: 4,584,730

[45] Date of Patent: Apr. 29, 1986

[54] DEVICE FOR STABILIZING THE PELVIS OF A PATIENT LYING ON HIS SIDE

[76] Inventor: Eva Rajan, Stålstigen 8, S-582 58 Linköping, Sweden

[21] Appl. No.: 631,435

[22] PCT Filed: Dec. 7, 1983

[86] PCT No.: PCT/SE83/00432

§ 371 Date: Jul. 13, 1984

§ 102(e) Date: Jul. 13, 1984

[87] PCT Pub. No.: WO84/02268

PCT Pub. Date: Jun. 21, 1984

[30] Foreign Application Priority Data

Dec. 13, 1982 [SE] Sweden ..... 8207119

[51] Int. Cl.[4] ..... A47C 20/00; A61F 5/00

[52] U.S. Cl. ..... 5/431; 5/437; 5/440; 5/443; 128/78; 128/80 R

[58] Field of Search ..... 5/431, 434, 436, 437, 5/440, 443, 444; 128/78, 80 R, 80 A–80 D, 79, 133, 134; 269/328

[56] References Cited

U.S. PATENT DOCUMENTS

| | | | |
|---|---|---|---|
| 2,700,779 | 2/1955 | Tolkowsky | 5/436 |
| 2,795,802 | 6/1957 | Myers | 5/436 |
| 2,940,087 | 6/1960 | Kieffer | 5/440 |
| 3,604,023 | 9/1971 | Lynch | 5/431 |
| 3,843,980 | 10/1974 | Rodriguez | 5/431 |
| 3,931,654 | 11/1974 | Spann | 5/443 |
| 4,233,700 | 11/1980 | Spann | 5/431 |
| 4,390,015 | 6/1983 | Clements | 128/133 |
| 4,441,221 | 4/1984 | Enste et al. | 5/431 |
| 4,453,540 | 6/1984 | Frain | 5/431 |

*Primary Examiner*—Kenneth J. Dorner
*Assistant Examiner*—Michael F. Trettel
*Attorney, Agent, or Firm*—Flynn, Thiel, Boutell & Tanis

[57] ABSTRACT

A device for stabilizing the pelvis of a lying patient in a preselected angular position relative to a conventional flat bed includes a generally, disc shaped body with two basically parallel planar surfaces. The body is intended to be placed between the lower extremities of the patient and is designed with a cavity, which extends from the edge of the body toward its center and conforms to and is somewhat bigger than the contours of the patient's pelvis as seen from the side, and has parts protruding from the respective planar surfaces, and preferably arranged in pairs on opposite sides of the body. The protruding parts are arranged to support the body far enough above the bed to give room for one extremity between the bed and the planar surface facing the bed while the other extremity rests on the opposite planar surface, thereby providing some moving space for the extremities between the protruding parts. In the said cavity supporting surfaces are arranged to support the lumbar region of the patient on one side and on the other side the hip bones of the patient, whereby the pelvis is stabilized essentially at a right angle to the bed.

18 Claims, 3 Drawing Figures

DEVICE FOR STABILIZING THE PELVIS OF A PATIENT LYING ON HIS SIDE

FIELD OF THE INVENTION

This invention relates to a device for stabilizing the pelvis of a lying patient in a preselected angular position relative to a conventional flat bed.

BACKGROUND OF THE INVENTION

Handicapped children with e.g. brain damage which occurred before, during or just after birth do not have full control over their body functions, and often have a limited ability to move and have some characteristic patterns of movement and resting positions. In particular the resting positions are often incorrect and in the long run cause thrust loads in the lumbar region, hip joint luxations and gradual damage to the ability to sit. Also, with elderly people, who are forced to stay in bed permanently or for long periods of time there are risks of damage of such type and also risks for bedsores.

There is already a device on the market, consisting of a rest, somewhat shorter than the patient, and mainly designed like a seat with a back rest. Belonging to this there is a cushion intended to be placed between the patient's legs and one or more straps to keep the patient lying on his side with his back turned to the back rest.

However, the known device has a number of disadvantages. It is comparatively big and it is cumbersome to turn the patient from one side to the other. The cushion intended for leg support is completely loose and easily moves into positions where it does not serve any purpose.

SUMMARY OF THE INVENTION

A purpose of this invention is to provide a device of such type which does not have these disadvantages. For example it preferably leaves some space for moving the extremities and provides support for the lumbar region of the patient on one side and on the other side for the patients hip bone, whereby the pelvis is stabilized at a right angle to the bed.

This is achieved according to the invention by providing a device which includes a body which from a general point of view is disc shaped with two basically parallel planar surfaces, is intended to be placed between the lower extremities of the patient and is designed with a cavity, which extends from one edge of the body toward its center and which conforms to and is somewhat bigger than the contour of the patient's pelvis as seen from the side. Projecting outwardly from the planar surface are protruding parts, preferably arranged in pairs on opposite sides of the body and arranged to keep the body up far enough from the bed so that there is room for one of the patients extremities between the bed and the planar surface facing the bed while the other extremity rests on the opposite planar surface, whereby there is a certain moving space for the extremities between the protruding parts and at the cavity the supporting surfaces are arranged to support the lumbar region of the patient on one and on the other side the hip bone of the patient.

According to a special characteristic of the invention the distance between said the planar surfaces is big enough for the lower extremities of the patient to rest mutually parallel and in line with the spine when using the device, one extremity on the bed and the other on the planar surface facing away from the bed. Thus the tension on the hip joint decreases, which gives relief to already injured hip joints and delays and possibly prevents hip joint luxation.

A according to another special characteristic of the invention at least one of the protruding parts serves as a support for the hip bones of the patient, is completely displaceable toward and away from the cavity and is detachable from the disc shaped body, so that device can be used while a young patient grows and the best possible lying position can always be achieved by adjusting the protruding parts.

According to a suitable design the protruding part or parts which support the back of the patient extend further out from the disc shaped body than the part which supports the hip bones of the patient in order to support the lumbar part of the patient.

It is desirable that such back parts are comparatively thin in a direction normal to the surface thereon supporting the patient and are preferably of a thickness which generally coincides with the distance that the back part or the back parts protrude from the respective planar surfaces of the disc. By designing the back part to be or back parts thin, turning of a patient lying in the device is facilitated.

According to further special characteristics of the invention the device includes support surfaces for the front of the patient's thighs to prevent abnormal knee upheaval, which is common amongst handicapped children and contributes to the problems discussed in the introduction. Furthermore the body which is the main part of the device, the parts protruding from the planar surfaces of the body and the supporting surfaces are manufactured from a soft, springing, non-rigid material such as foamed plastic to prevent pressure injuries on the patient. Alternatively the body comprises a rigid frame on which pads of e.g. foamed plastic are fixed.

BRIEF DESCRIPTION OF THE DRAWINGS

The invention will be explained further below with reference the enclosed where.

DETAILED DESCRIPTION

Figure 1:
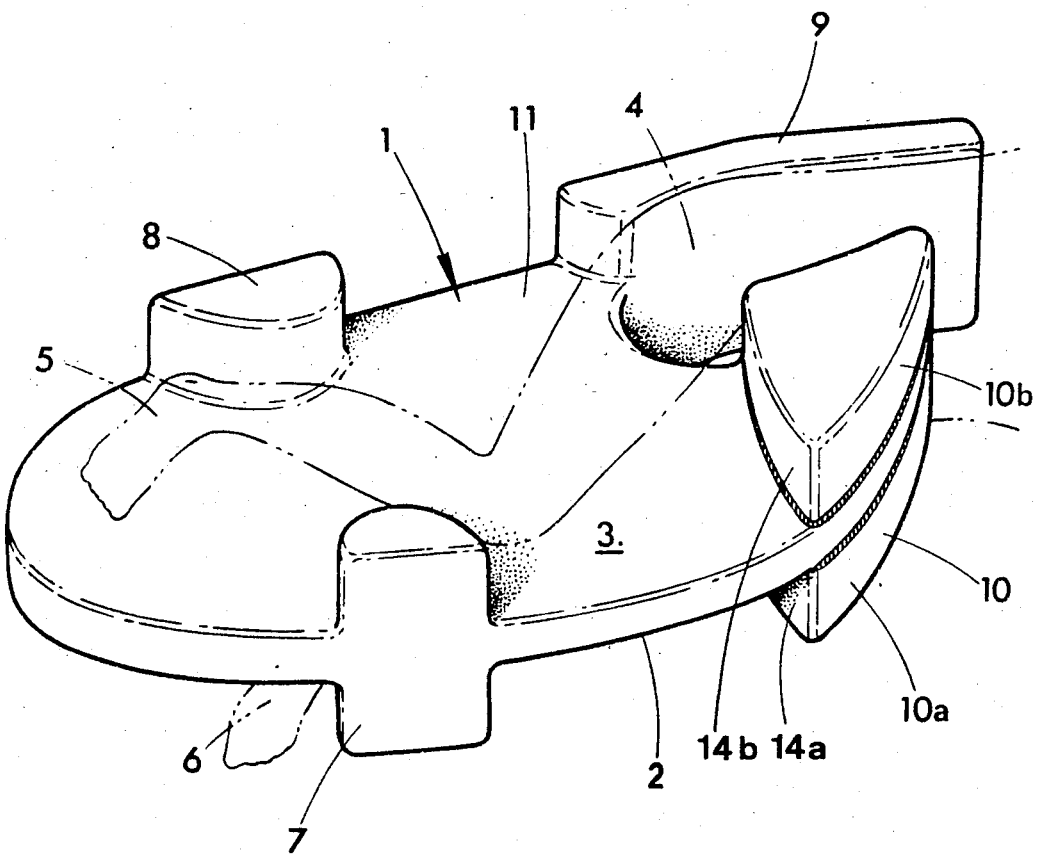
FIG. 1 shows a design of a device according to the invention in perspective.
Figure 2:
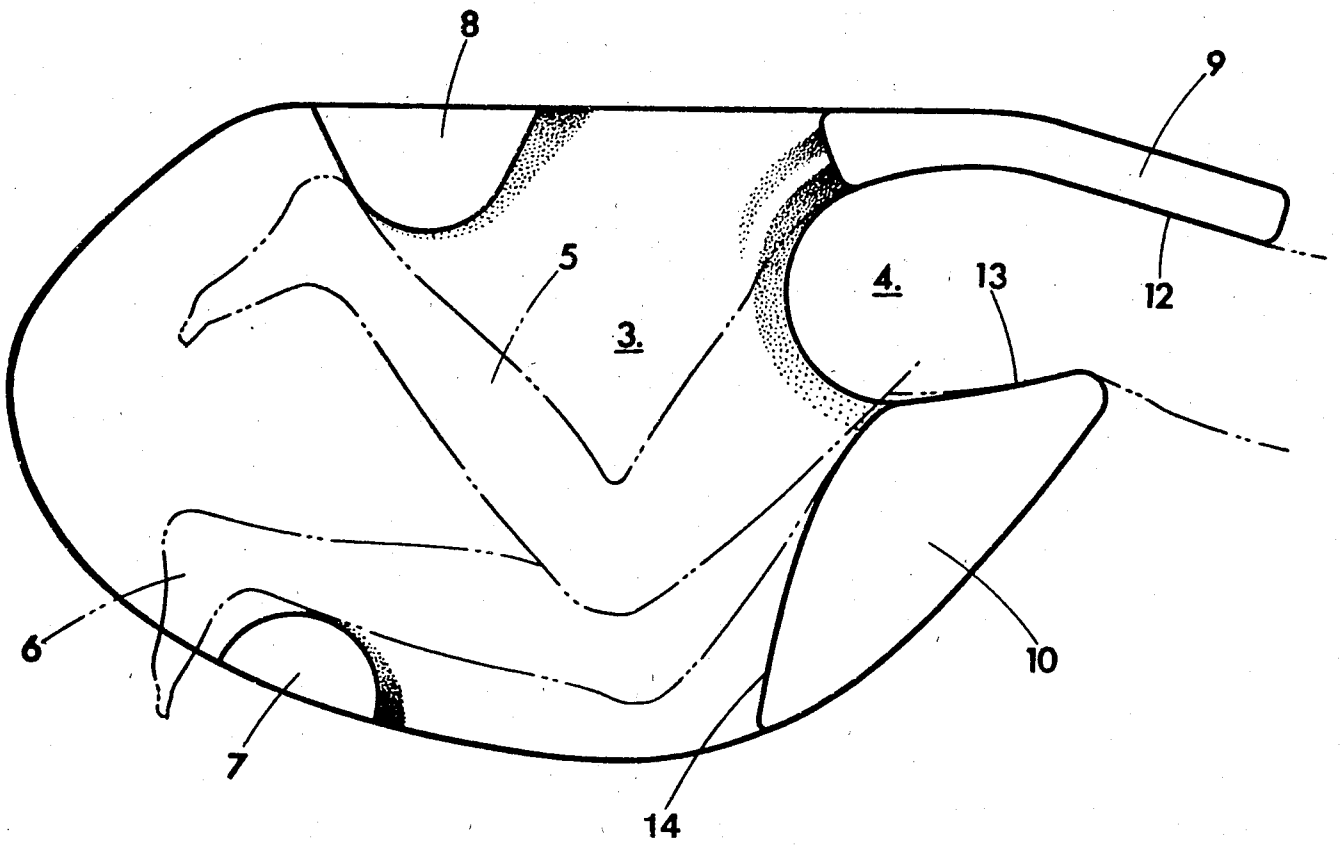
FIG. 2 shows the device according to FIG. 1 in a top view.

The device according to the invention is a support which includes a body 1 which from a general point of view is disc shaped with two basically parallel planar surfaces 2, 3. The body is designed with a cavity 4 which extends from one edge of the body toward its center. The cavity 4 is intended for the patient's pelvis such that the patient's lower extremities 5, 6 are placed on either side of the body 1, and the contour of the cavity conforms to and is somewhat bigger than the contour of the pelvis as seen from the side. The parts 7–10 protrude from the planar surfaces 2, 3 of the body 1, and are arranged in pairs on opposite sides of the body 1. On the drawing the parts protruding from the surface 2 have been marked with an a and similarly the parts protruding from the planar surface 3 have been marked with a b. The parts 7–10 have basically two objects. First they are arranged to support the disc shaped body far enough from the bed to make room for one of the patient's lower extremities or legs between the bed and the planar surface 2 and second they define the moving space or leg recess 11 for the patient's extremities. The distance between the surfaces 2, 3, i.e. the thickness of the body 1, is such that the extremities 5, 6 when using the device are mutually parallel and in line with the patient's spine. Thus the lower 6 of the lower extremities rests on the bed while the upper 5 of the lower extremities is resting on the planar surface 3.

To stabilize the patient's pelvis in the way the invention intends, supporting surfaces 12, 13 are arranged at the cavity 4. The supporting surface 12 is arranged to support the lumbar region of the patient while the supporting surface 13 has two parts respectively provided on the parts 10*a* and 10*b* and is arranged to support the hip bones of the patient. The supporting surface 12 is preferably integrated with the protruding part 9. In the same way the supporting surface 13 is integrated with the protruding parts 10*a* and 10*b*. To be able to adapt the device to a certain extent according to the size of the patient, the parts 10*a* and 10*b* are adjustable toward and away from the cavity. This is achieved because the parts 10*a* and 10*b* are completely adjustable toward and away from the cavity 4. To facilitate placing the patient in the device the parts 10*a* and 10*b* are detachable.

The part 9 to support the patient's back is designed in one piece and extends sufficiently from the disc shaped body to support the lumbar part of the patient.

As shown in the drawing the part 9 is comparatively thin so that turning the patient around the back part can take place easily and without much effort. The parts 8 protruding from both sides of the disc serve as foot rests for the patient and in FIG. 3 are displaceable on the disc so as to be adjustable into a desired position.

According to the invention the device includes supporting surfaces 14*a*, 14*b* for the patients thighs to prevent abnormal knee upheaval. These supporting surfaces are also integrated with the parts 10*a*, 10*b* and are preferably adjustable to limit the knee upheaval suitably according to the size of the patient.

Furthermore the parts 8*a* and 8*b* are preferably placed to stop the patient from bending his/hers knees too much.

Figure 3:
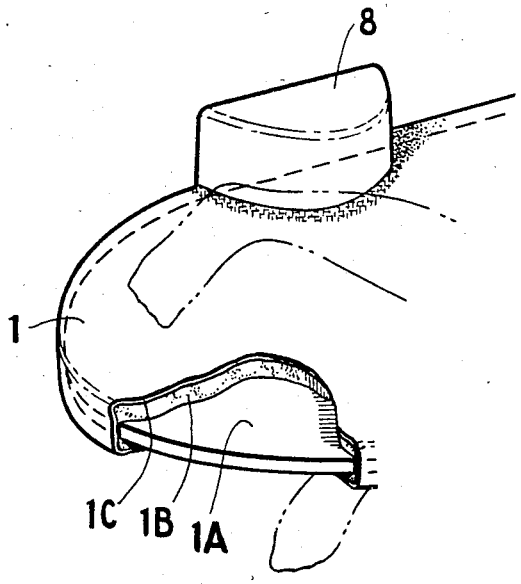
FIG. 3 is a fragmentary perspective view of the device of FIG. 1.

The device is manufactured from a soft, springing, non-rigid material such as foamed plastic but as shown in FIG. 3 can also consist of a rigid frame 1A with pads 1B of e.g. foamed plastic, fixed to it, and is in both cases covered by a protective material, as shown at 1C in FIG. 3.

The invention is not restricted to the above described design but a number of modifications are possible within the scope of possible demands. The parts 10*a* and 10*b* for example can be designed in one piece so that the whole front part creating the U-shaped cavity is detachable and adjustable toward and away from the patient's hip bones.

The embodiments of the invention in which an exclusive property or privilege is claimed are defined as follows:

1. A device for stabilizing the pelvis of a patient lying on his side in a conventional flat bed, comprising a body which is generally disc-shaped, has two approximately parallel planar surfaces defining opposite sides thereof, is intended to be placed between two lower extremities of the patient, and has a cavity which extends from one edge of the body toward the center thereof and which conforms to and is somewhat bigger than the contour of the patient's pelvis as seen from the side, and including protruding parts which project outwardly from said planar surfaces on opposite sides of said body and can support the body parallel to and sufficiently far above the bed so that there is room for one of the patient's lower extremities between the bed and one of the planar surfaces which faces the bed, the other of the patient's extremities resting on the opposite planar surface, wherein a moving space for movement of the lower extremities exists between said protruding parts on each side of said body, and wherein said cavity has supporting surfaces which support the lumbar region on one side of the patient and the hip bone of the patient on the other side of the patient, whereby the pelvis is stabilized substantially at a right angle to the bed.

2. The device according to claim 1, wherein the distance between said planar surfaces is selected so that the two lower extremities of the patient lie in planes which are parallel to each other and in line with the spine, a first of the lower extremities resting on the bed and a second of the lower extremities resting on the planar surface facing away from the bed.

3. The device according to claim 1, wherein at least one of said protruding parts serves as a support for the hip bone of the patient, is displaceable toward and away from the cavity, and is detachable from the disc-shaped body.

4. The device according to claim 1, wherein two of said protruding parts have thereon portions of the support surface which supports the lumbar region of the patient and are provided on a portion of the disc-shaped body which extends outwardly farther than a further portion thereof which has thereon two of the protruding parts on which respective portions of said support surface for the hip bone of the patient are provided.

5. The device according to claim 4, wherein said protruding parts serving as a support for the patient's back have, in a direction perpendicular to the support surface supporting the back of the patient, a thickness which generally coincides with the distance that each such part protrudes from the associated planar surface of the body.

6. The device according to claim 4, wherein said protruding parts which support the patient's hip bones are respective portions of a single integral member which is detachable from the body at a level approximately aligned with the inner end of the cavity and which is displaceable in a direction toward and away from the hip bones of the patient.

7. The device according to claim 1, wherein two of said protruding parts serve as foot-rests and are displaceably supported on the body.

8. The device according to claim 1, wherein two of said protruding parts have support surfaces which can engage the fronts of the patient's thighs to prevent abnormal knee upheaval.

9. The device according to claim 1, wherein said body and said protruding parts are manufactured from a soft resilient non-rigid material such as a foamed plastic.

10. The device according to claim 1, wherein the body includes a rigid frame having thereon pads of a soft resilient non-rigid material such as a foamed plastic.

11. A device for stabilizing the pelvis of a patient lying on his side on a flat surface, comprising a support having means defining outwardly facing surfaces on opposite sides thereof which can each engage the flat surface, having a pelvis cavity which extends thereinto from an edge portion thereof, and having in each of said surfaces a leg recess which communicates with said pelvis cavity, said pelvis cavity and said leg recesses respectively receiving the pelvis and legs of the patient during use of the device, said support having thereon in said pelvis cavity a back support surface which can engage and support the lumbar region of the patient, and including hip support means provided on a side of said cavity opposite said back support surface, adjustable toward and away from said back support surface relative to said support, and having spaced hip support surfaces thereon which face said back support surface and which can each engage a respective hip of the patient on the front side of the patient's pelvis.

12. The device according to claim 11, wherein said support includes an approximately flat body having approximately planar surfaces on opposite sides thereof and a plurality of protruding parts projecting outwardly from each of said planar surfaces, said outwardly facing surfaces which can engage the flat surface being provided on ends of said protruding parts remote from said body, and at least one of said protruding parts on each side of said body being displaceably supported on said body.

13. A device for stabilizing the pelvis of a patient lying on his side on a flat surface, comprising: an approximately flat body having outwardly facing surfaces on opposite sides thereof and having a cavity which extends thereinto from an edge portion thereof and which is adapted to receive the pelvis of the patient, the legs of the patient then being disposed on opposite sides of said body, said cavity having a back support surface which can engage and support the lumbar region of the patient; protruding means projecting outwardly from said surfaces on each side of said body and adapted to support said body parallel to and a predetermined distance above the flat surface; and hip support means provided on a side of said cavity opposite said back support surface, adjustable toward and away from said support surface relative to said body, and having spaced hip support surfaces thereon which face said back support surface and can each engage a respective hip of the patient on the fromt side of the patient's pelvis.

14. The device according to claim 13, wherein said protruding means includes a plurality of protruding parts provided on and projecting outwardly from each of said surfaces on said body, a first of said protruding parts on each side of said body being adjacent said cavity in the region of said back support surface therein, said back support surface extending across said first protruding parts.

15. The device according to claim 14, wherein said hip support means includes a second of said protruding parts on each side of said body being located on a side of said cavity opposite said first protruding parts, being displaceably supported on the associated surface on said body, and having a respective one of said hip support surfaces thereon.

16. The device according to claim 15, wherein each of said second protruding parts has thereon a surface which can engage a thigh of the patient to limit movement of the leg of the patient.

17. The device according to claim 15, wherein a third and a fourth of said protruding parts on each side of said body are respectively adapted to engage a shin and a foot of the patient in order to limit movement of the associated leg of the patient.

18. The device according to claim 17, wherein each said fourth protruding part is displaceably supported on said body.

* * * * *